US006433749B1

(12) United States Patent
Thompson

(10) Patent No.: US 6,433,749 B1
(45) Date of Patent: Aug. 13, 2002

(54) ANTENNA ASSEMBLY

(75) Inventor: Alan Thompson, Isle of Wight (GB)

(73) Assignee: Harada Inductries (Europe) Limited, Birmingham (GB)

( * ) Notice: Subject to any disclaimer, the term of this patent is extended or adjusted under 35 U.S.C. 154(b) by 0 days.

(21) Appl. No.: 09/719,799

(22) PCT Filed: Jun. 11, 1999

(86) PCT No.: PCT/GB99/01860

§ 371 (c)(1),
(2), (4) Date: Feb. 26, 2001

(87) PCT Pub. No.: WO99/66595

PCT Pub. Date: Dec. 23, 1999

(30) Foreign Application Priority Data

Jun. 17, 1998 (GB) ..... 9813130

(51) Int. Cl.[7] ..... H01Q 1/32; H01Q 1/38

(52) U.S. Cl. ..... 343/713; 343/700 MS; 343/725; 343/853

(58) Field of Search ..... 343/711, 713, 343/700 MS, 725, 726, 727, 853; 359/143, 145

(56) References Cited

U.S. PATENT DOCUMENTS

| | | | | | |
|---|---|---|---|---|---|
| 5,300,936 | A | * | 4/1994 | Izadian | 343/700 MS |
| 5,400,039 | A | * | 3/1995 | Araki et al. | 343/700 MS |
| 5,801,865 | A | * | 9/1998 | Weis et al. | 359/145 |
| 6,043,783 | A | * | 3/2000 | Endo et al. | 343/713 |
| 6,091,527 | A | * | 7/2000 | Brisse et al. | 359/143 |

FOREIGN PATENT DOCUMENTS

| | | |
|---|---|---|
| EP | 0806851 | 11/1997 |

* cited by examiner

*Primary Examiner*—Don Wong
*Assistant Examiner*—Hoang Nguyen
(74) *Attorney, Agent, or Firm*—Pennie & Edmonds LLP

(57) ABSTRACT

An antenna module for a road vehicle comprising a structure including a plurality of antennas having different functions and configured to be mounted on or conform to a surface of the vehicle, a data bus for conveying in a digital format, signals received by or to be transmitted by the antenna between the module and equipment comprised in the vehicle, and means for converting received signals into said format and for converting signals to be transmitted from that format into a form for transmission.

12 Claims, 4 Drawing Sheets

ANTENNA ASSEMBLY

Figure 1:
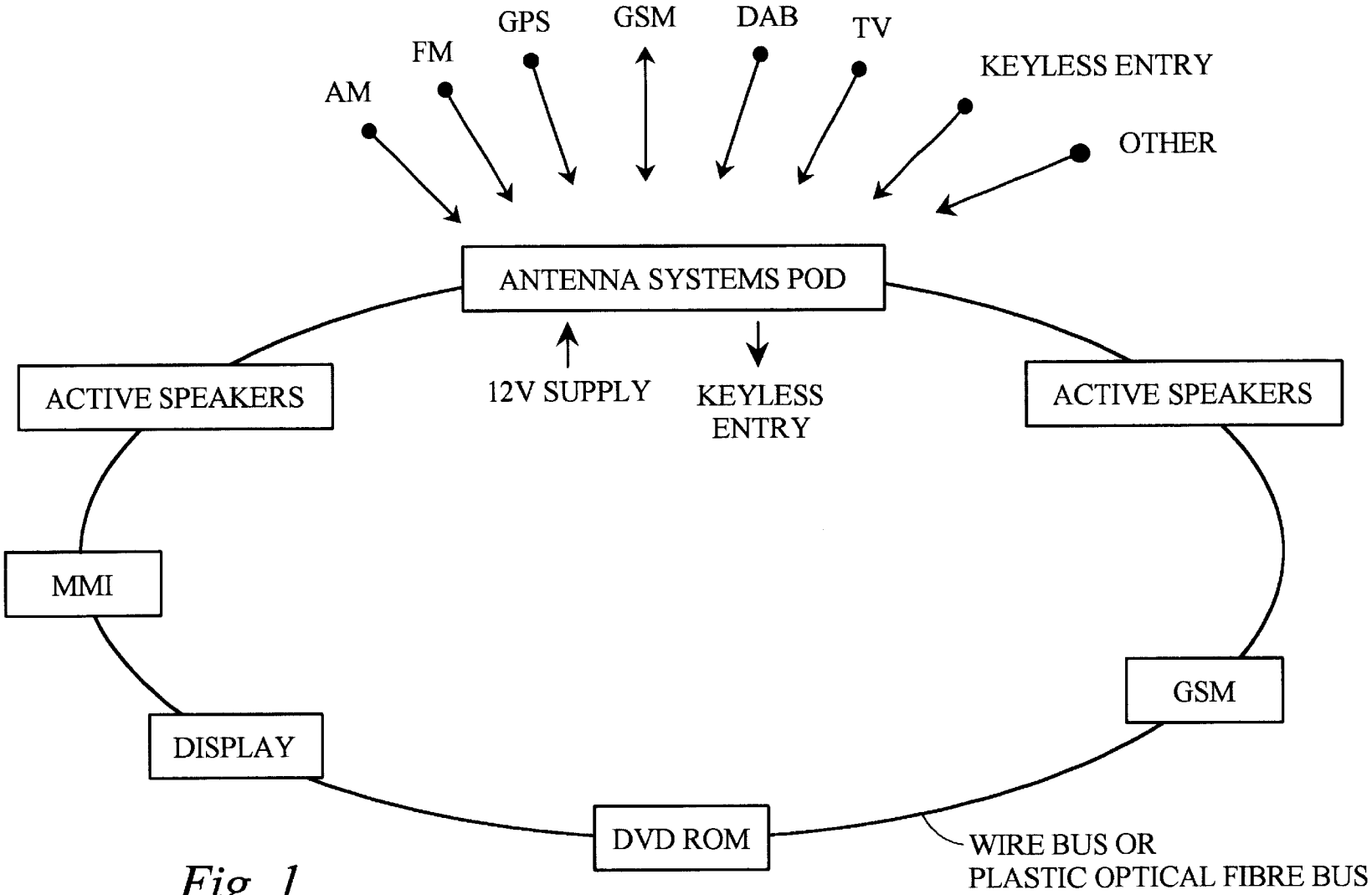

This invention relates to an antenna assembly of modular form for use in road vehicles.

For many years a single antenna was considered sufficient to satisfy the signal reception requirements of the AM/FM radio which is commonly installed in motor vehicles. In recent years additional antennas and associated diversity electronics have been introduced in order to eliminate or reduce the audio distortions that can be experienced when driving in a multipath signal environment.

As other services, such as mobile telephone (e.g, GSM) and global positioning by satellite (GPS), have been introduced, it has been necessary to add other antennas to the motor vehicle. Further services are planned which will lead to numerous other antennas also being added to the vehicle, More than twelve antenna elements could be required for the reception of existing and currently envisaged services.

The integration of so many antennas into a vehicle presents a number of problems in the design, manufacture, installation, test, servicing and upgrading phases of the product life-cycle,.

Car-designers generally impose severe constraints in terms of the allocated space, the permitted locations, the mechanical interfaces, the electrical interfaces, etc for these antennas.

For a number of years car manufacturers have provided vehicles with antennas integrated into the rear windows, so-called glass antennas, in order to offer a lower cost alternative to the more familiar external whip or telescopic mast antennas. However, the system performance obtained with these glass antennas is often compromised because the shape or form of antennas for good electrical performance is generally not compatible with the dominant aesthetic requirements. This situation is aggravated when a large number of antennas are required. Connecting tracks are used to route the signals from (or to) the glass antenna elements. Cross-over connections to these tracks are difficult to avoid and connections to screened cables and associated electronic assemblies are relatively expensive to implement reliably.

Glass antenna technology is used by the original equipment manufacturer and the antenna cannot be replaced or modified without replacing the window glass itself. Thus glass antenna technology is not appropriate for the upgrading of the antenna systems that may later be required when new services are introduced, or for the after-market.

U.S. Pat. No. 5,400,039 (Hitachi, Ltd.) discloses an integrated multi-layered microwave circuit in which conductive layers and dielectric layers are alternately laminated. A first conductive layer on one major face forms an antenna interface, and a second conductive layer on the other major face forms a circuit pattern to which discrete parts are fitted. The first and second conductive layers are connected to feed an antenna signal. Dielectric layers separate a ground layer and power source layer from each other and from the first and second conductive layers. The first conductive layer forming the antenna interface has three circular antenna radiators connected together with phase shifters.

European Patent Appln. 0 590 955 (Loral Aerospace) discloses an antenna for receiving signals in a plurality of frequency bands, and European Patent Appln. 0 806 851 (Becker GmbH) discloses that an optical data bus may be in vehicular communications.

The present invention, at least in its preferred embodiments, seeks to avoid at least some of disadvantages mentioned above. In principle, it is applicable equally to transmitting antennas and receiving antennas, and the claims are to be interpreted accordingly.

In one aspect, the invention provides an antenna module for a road vehicle comprises a structure including a plurality of antennas for receiving and/or transmitting different types of signals, and configured to be mounted in or on the vehicle, a data bus for conveying in a digital format signals received by and/or to be transmitted by the antennas between the module and equipment comprised in the vehicle, and means for converting received signals into said format and/or for converting signals to be transmitted from that format into a form for transmission.

The antennas may provide for reception and/or transmission of two or more signals of the following types: FM broadcast radio, AM broadcast radio, digital audio broadcasts, analogue broadcast television, digital broadcast television, telephony, other two-way radio communications, position fixing, station keeping, vehicle guidance, vehicle security, vehicle identification, tolling, emergency calls. 'Broadcast' includes both terrestrial and satellite transmissions, whether free-on-air or pay-to-receive.

The structure may contain active systems for signal processing before transmission or after reception.

The connection means may be adapted for conveying signals relating to vehicle security to or from the vehicle separately from other signals.

The data bus may be an optical bus.

Preferably the structure is of material substantially transparent to electromagnetic radiation.

At least one said antenna may be integrated into or disposed on the fabric of the structure.

Alternatively or in addition the structure may be a housing within which at least one said antenna is contained. The module may comprise means for mounting it on an external surface of the vehicle, and shaped to conform with the styling thereof, and/or to perform a aerodynamic function.

At least one said active system may be disposed within the housing. The module may be configured as a spoiler, fairing, airdam or fin.

At least one of the antennas may be a pattern of conductive material printed, etched or otherwise disposed on a dielectric substrate.

The module may be shaped to conform to a surface (eg. an inner surface) of a window, window surround or body panel of the vehicle.

Alternatively there may be means for mounting the module on an external surface of the vehicle, and shaped to conform with the styling thereof.

The module may be configured as a spoiler, fairing or fin for mounting towards the rear of the vehicle.

The invention will now be described merely by way of example with reference to the accompanying drawings, wherein FIG. 1 illustrates the concept of the invention.

Figure 2C:
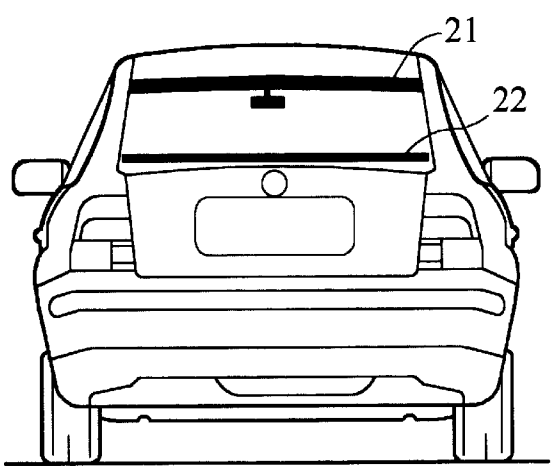
Figure 2B:
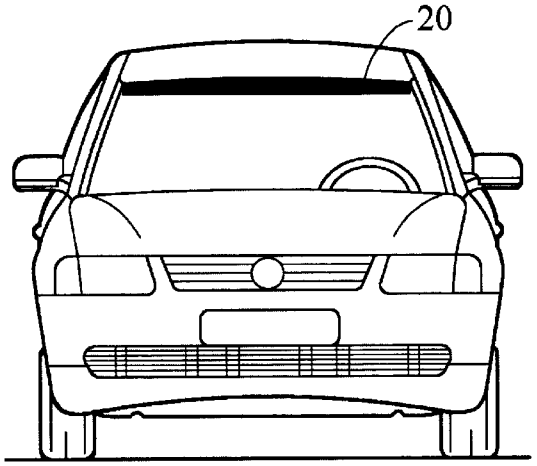
Figure 2A:
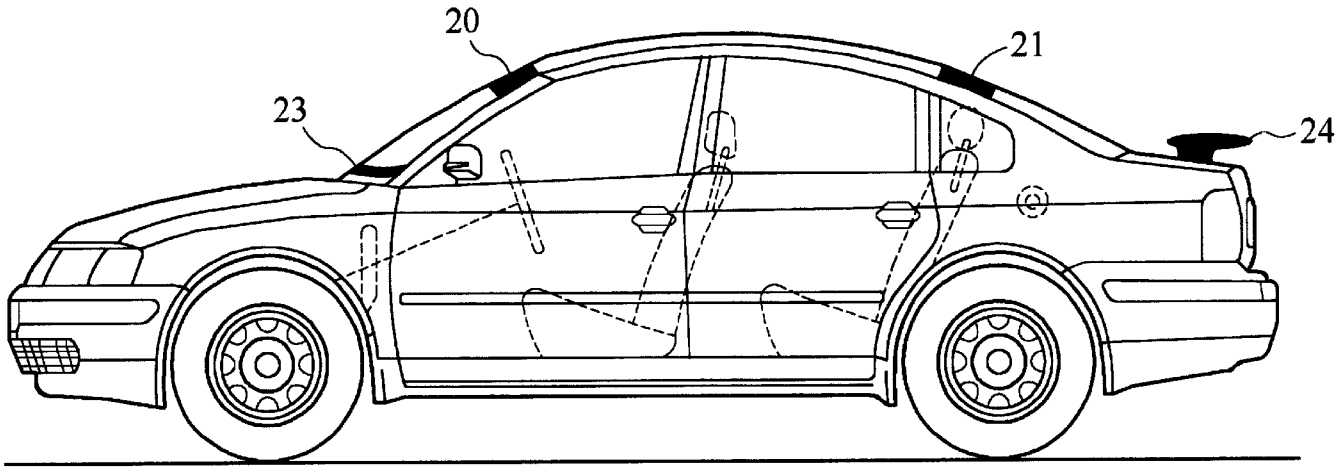
Figure 3:
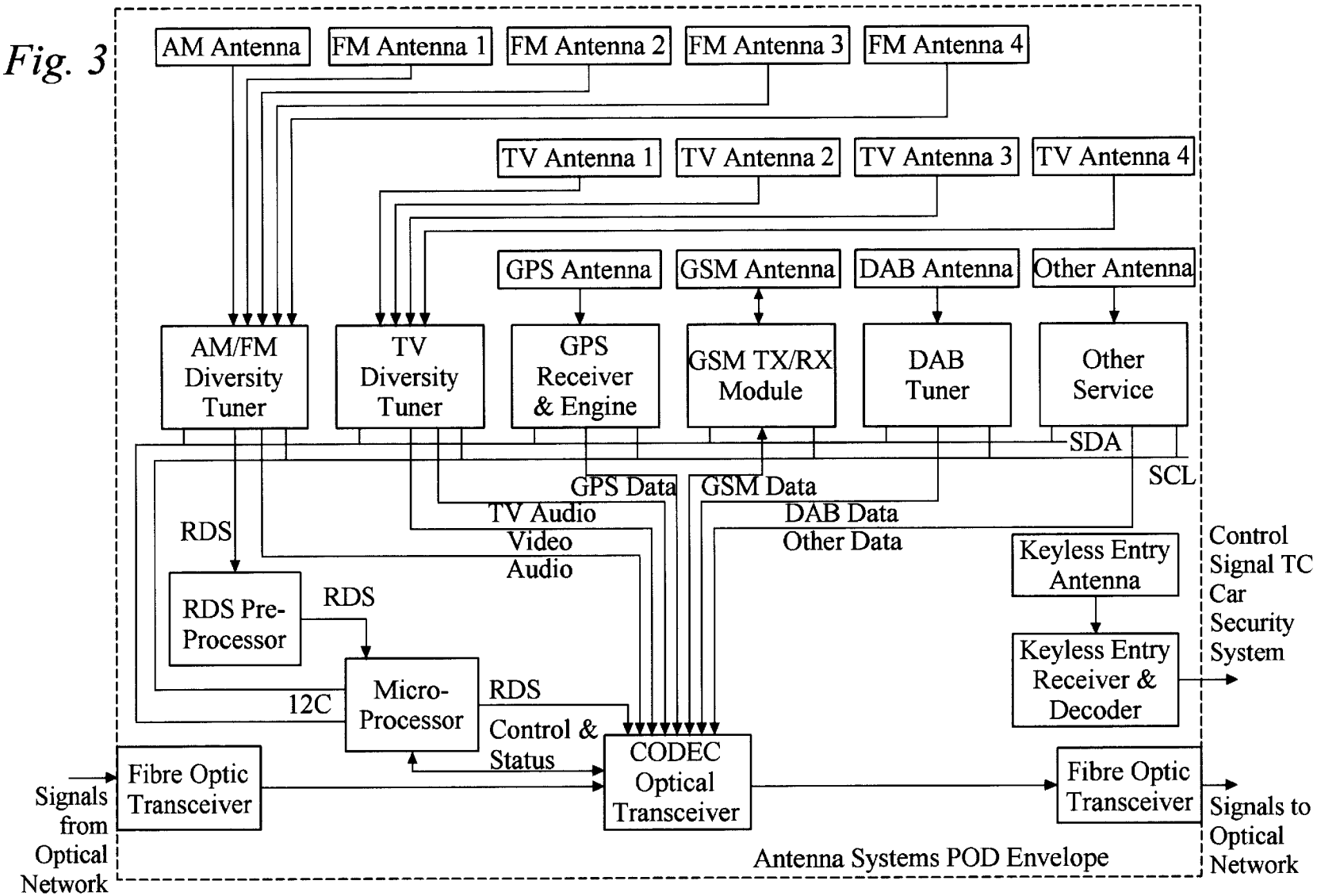
Figure 4:
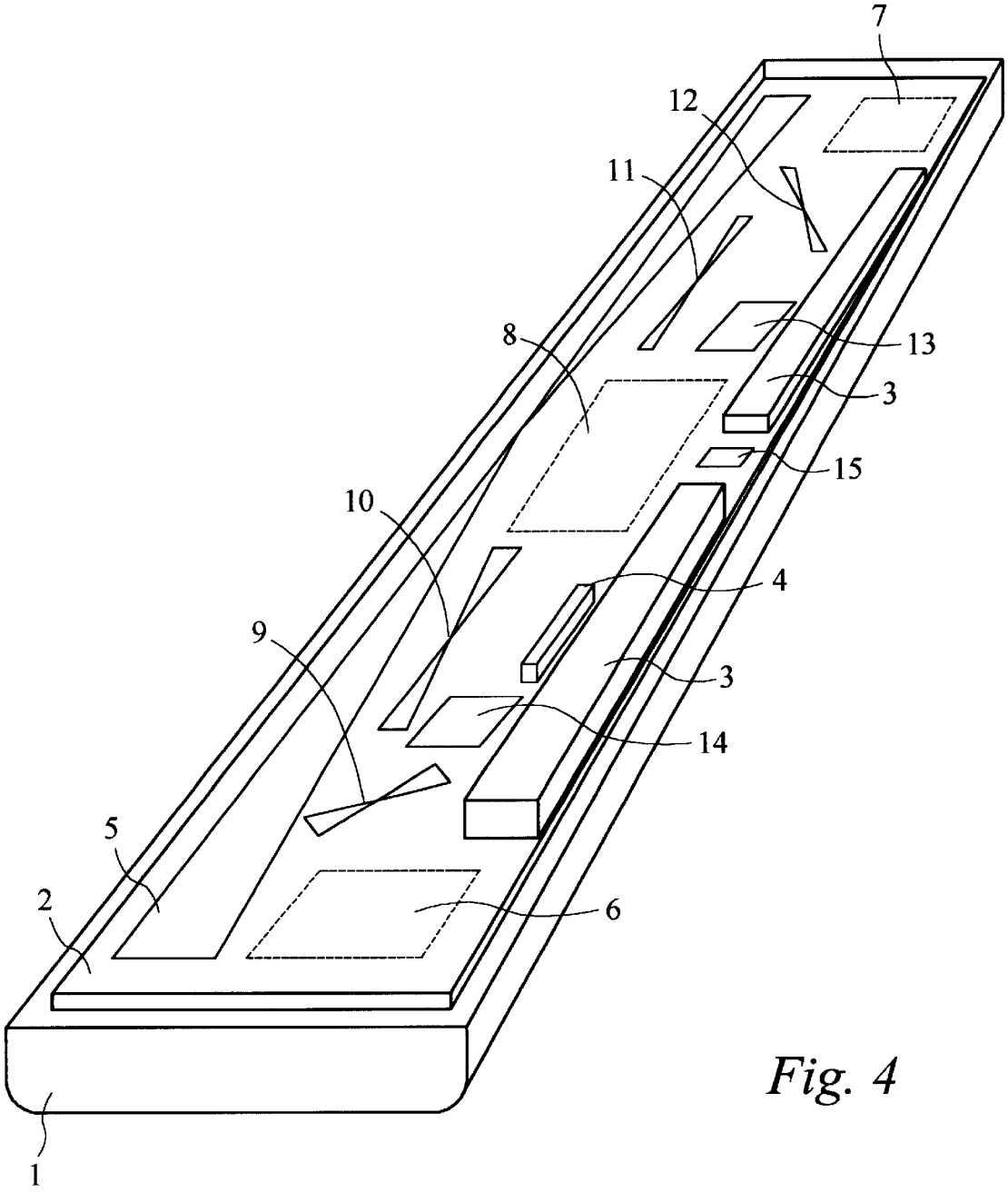

FIG. 2 shows some possible locations in a vehicle for an antenna module according to the invention FIG. 3 is a system diagram of a module according to the invention, and FIG. 4 shows an antenna module according to the invention.

Because FIGS. 1 and 3 are fully captioned, reference numerals are not used in these figures. Instead the description of those figures will proceed using the captioned terms.

The antenna module consists of a pod or other structure shaped to conform to a suitable radio-transparent inner surface of the vehicle such as a window, a non-metallic panel such as a boot (trunk) lid, roof, wing or bumper (fender).

Referring to FIG. 1, the antenna systems pod contains all the antennas necessary for the reception of signals which are required for the vehicle's in-car multimedia and communication facilities such as AM/FM radio, analogue/digital television, digital audio broadcasts (DAB), global positioning system (GPS), mobile telephony (GSM), keyless entry, etc.

The pod also contains the electronic sub-systems, including RF amplifiers, diversity chips, switches, tuner chips and transmitters that are required to provide some or all of the in-car facilities mentioned above.

The pod has few electrical interfaces: e,g. a 12 V or other low voltage supply, a principal network connection for a single data bus (either an optical fibre or wire bus), and a separate connection to a keyless entry security system of the vehicle.

Referring to FIG. 2, some possible mounting positions are shown for the pod in a typical modern vehicle, here a Volkswagen Passat. VOLKSWAGEN, PASSAT and the VW logo visible in FIG. 2 are registered trade marks.

The locations illustrated are the top of the windscreen 20, the top 21 or bottom 22 of the rear window, the top of the fascia 23, and a rear Spoiler 24.

To reduce costs, these positions should be considered as alternatives. However more than one pod may be used if optimisation of the performance of the various systems require it.

Where the pod is to be mounted on a window, it conveniently can consist of an antenna portion in which the antenna patterns are formed on a transparent flexible substrate for attachment to the window and a systems portion which is located just outside the window area, e.g. along the window frame or under an adjacent head lining.

A vehicle which employs composite panels presents a larger number of options for mounting positions. For example, the pod could be incorporated in, or conformably mounted against the airdam or fairing often fitted to the cab roof of an articulated tractor unit to reduce the drag or turbulence of a tall semi-trailer. Alternatively it could be conformably mounted behind the bumper or one of the several other glass-fibre body panels of a truck cab.

FIG. 3 is a system block diagram of the functional units contained within the envelope of the pod. Optical signals, containing control data generated by a man machine interface in the vehicle (MMI, shown in FIG. 1) are received, via the single optical bus, by a fibre optic transceiver and converted to electrical signals before being passed to a codec optical transceiver. The codec optical transceiver routes this control data to a microprocessor which then controls an AM/FM diversity tuner, a TV diversity tuners a GPS receiver and engine, a GSM transmit/receive (TX/RX) module, a DAB tuner and other service items that are connected to an $I^2C$ bus within the pod.

The AM/FM diversity tuner receives its signals either from an AM antenna or from one of four FM antennas according to band selection. When tuned to the FM band, the diversity electronics of the FM tuner selects the antenna that offers the signal with the least multipath distortion. Alternatively the diversity electronics may apply amplitude and phase weighting to some or all of the signals received by the FM antennas in order to minimise the effects of multipath distortion.

Radio data system (RDS) information (information regarding the identity of the received station, traffic information etc) is passed to the codec optical transceiver via the RDS pre-processor and the microprocessor. Audio signals are also passed to the codec optical transceiver.

The diversity electronics of the TV tuner selects one of four TV antennas that offers the signal with the least multipath distortion. Alternatively the diversity electronics may apply amplitude and phase weighting to some or all of the signals received by the TV antennas in order to minimise the effects of the nultipath distortion. Video and audio signals from the TV diversity tuner are passed to the codes optical transceiver.

The GPS receiver and engine, GSM TX/RX module, DAB tuner and the other services each receive signals from their respective antennas. Amongst other services envisaged for the future are road tolling, station keeping relative to the preceding vehicle (the pod would then be mounted to accommodate the necessary forward-looking antenna) and vehicle guidance when the necessary highway infrastructure systems are in place.

The codec optical transceiver receives GPS data, GSM data, DAB data and other data from the GPS receiver and engine, GSM TX/RX module, DAB tuner and other services respectively.

All the data, including status data, received by the codec optical transceiver is processed (in particular digitised, if not already digital) and packed into frames if necessary for the transmission protocol before being passed to a second fibre optic transceiver for transmission to the other devices (shown in FIG. 1) are connected to the single optical network (bus).

For security and safety reasons the control signal from the keyless entry receiver and decoder preferably is not sent with the other data over the optical network but is sent separately to the car security system. However in some circumstances, eg. an adequately high level of encryption or security, the keyless entry signals may be sent via the optical network.

The single network connection carries communications from all the antennas to the control unit and other devices on the network. The data is coded and transmitted using a common protocol for the devices. One such example of a protocol is called MOST—Media Orientated Systems Transport. The network passes the coded digital information in a common format so that the central processor can communicate with all other devices. The MOST network is wide bandwidth so that the multimedia data can be transferred using a single system clock. Alternatively asynchronous packet data can be handled as well. The bandwidth is programmable in real time and one node can communicate with another unencumbered. Since the intelligence is in the network it is suitable for consumer electronics applications. The network can be optimised for the chosen peripheral devices connected.

FIG. 4 shows an open view of the pod. It comprises a two-part housing or casing, the upper part of the casing (not shown) having been removed from the lower part of the casing 1, to reveal an antenna board 2 and the system electronics modules 3.

The casing of the pod is made of plastics or other suitably rigid composite material that is transparent to electromagnetic radiation. The casing is shaped to conform to the window and body of the cat or, when mounted as a spoiler, to the aerodynamic and aesthetic requirements.

The antenna board comprises a copper clad laminate and provides the numerous antennas. These are formed either by etching the copper of the antenna board or by mounting separate antennas on the antenna board. Other known methods of antenna construction may be used, e.g. screen printing a silver layer in the required patterns.

In this example, the AM antenna comprises wire windings on a ferrite rod 4. The FM antennas consist of a bow-tie dipole antenna 5, and fractal antennas 6,7 and 8.

The TV antennas are shown as bow-tie dipoles 9, 10, 11 and 12.

The GPS antenna is a patch antenna 13, the GSM antenna is formed by a slot 14 and the keyless entry antenna is also formed by a slot 15. The antennas for the other services (not shown) would take the appropriate form according to the frequency of operation and radiation pattern requirements.

Connecting lines (not shown) from the numerous antennas to electronics modules are made either by means of tracks etched in the copper of the antenna board or by means of coaxial cables or by a combination of these means.

As an alternative to a separate antenna board, some or all of the antennas may be printed or etched on the surface of the casing itself, or may be integrated into it (potted) when the casing is manufactured, e.g. by injection moulding.

Some benefits offered by the antenna module as described include:

The costs and constraints of glass antennas are avoided.

Complex systems are more easily accommodated.

Cross-over of tracks is permitted.

Electrical and mechanical interfaces are simplified.

Cable harnesses are almost eliminated.

All antennas and sub-systems can be tested prior to installation in the vehicle.

Mounting can be either internal or external.

Upgrading of systems can be accommodated.

The concept can be applied both to the OEM and after-markets.

Servicing is simplified,

The invention also includes any novel features or combination of features disclosed in the specification (which term includes the claims) whether or not presently claimed.

What is claimed is:

1. An antenna module for a road vehicle, comprising:

a structure adapted to be mounted in or on the vehicle;

at least two groups of antennas carried by the structure, each group being adapted to receive and/or transmit signals within a frequency band different from that of each other group, each group consisting of one or more antennas that receive and/or transmit signals of the same or a similar frequency;

a converter for converting signals received by respective groups of the antennas into a common digital format for transmission to at least one station within the vehicle, and for converting each signal received from the at least one station in the common digital format into a form for transmission by that one of the groups of antennas adapted, based on signal frequency, to transmit that signal; and a data bus for conveying between the converter and the at least one station, in the common digital format, all of the signals received and/or transmitted by the antennas.

2. An antenna module as claimed in claim 1, wherein each of the signals of the same or similar frequency comprises one type from among the following types of signals: FM broadcast radio, AM broadcast radio, digital audio broadcast, analog broadcast television, digital broadcast television, telephony or other two-way radio communications, position fixing, station keeping, vehicle guidance, vehicle safety, vehicle identification, tolling, emergency calls.

3. An antenna module as claimed in claim 1, wherein one of the antennas provides for reception or transmission of signals relating to vehicle security, and wherein the data bus and the converter have separate circuitry for handling such signals separately from other signals.

4. An antenna module as claimed in claim 1, wherein the data bus is an optical bus.

5. An antenna module as claimed in claim 1, wherein the structure is of a material substantially transparent to electromagnetic radiation.

6. An antenna module as claimed in claim 1, wherein at least one of the antennas is integrated into or disposed on the fabric of the structure.

7. An antenna module as claimed in claim 6, wherein the at least one of the antennas is a pattern of conductive material printed, etched, or otherwise disposed on a dielectric substrate.

8. An antenna module as claimed in claim 1, wherein the structure is a housing within which the at least two groups of antennas are contained.

9. An antenna module as claimed in claim 8, wherein at least one active system is disposed within the housing.

10. An antenna module as claimed in claim 1, wherein the module is shaped to conform to a surface of a window, window surround, or body panel of the vehicle.

11. An antenna module as claimed in claim 1, further comprising a mounting for mounting the module on an external surface of the vehicle, the mounting being shaped to conform with the styling of the vehicle or to perform an aerodynamic function.

12. An antenna module as claimed in claim 11, wherein the module is configured as a spoiler, fairing, airdam, or fin.

* * * * *